US009936273B2

(12) United States Patent
Biggs

(10) Patent No.: US 9,936,273 B2
(45) Date of Patent: Apr. 3, 2018

(54) APPARATUS AND METHODS FOR ALTERING THE APPEARANCE OF WEARABLE DEVICES

(71) Applicant: Taction Technology Inc., Los Gatos, CA (US)

(72) Inventor: Silmon James Biggs, Los Gatos, CA (US)

(73) Assignee: Taction Technology, Inc., Los Gatos, CA (US)

( * ) Notice: Subject to any disclaimer, the term of this patent is extended or adjusted under 35 U.S.C. 154(b) by 0 days.

(21) Appl. No.: 15/002,367

(22) Filed: Jan. 20, 2016

(65) Prior Publication Data

US 2016/0212515 A1 Jul. 21, 2016

Related U.S. Application Data

(60) Provisional application No. 62/105,356, filed on Jan. 20, 2015.

(51) Int. Cl.
*H04R 1/02* (2006.01)
*H04R 1/10* (2006.01)
*H04S 7/00* (2006.01)

(52) U.S. Cl.
CPC ..... *H04R 1/028* (2013.01); *H04R 1/1008* (2013.01); *H04R 1/1041* (2013.01); *H04S 7/00* (2013.01); *H04R 2499/15* (2013.01); *H04S 2420/01* (2013.01)

(58) Field of Classification Search
CPC ..... H04R 1/1091; H04R 3/00; H04R 5/033; H04R 25/606; H04R 29/00; G06F 3/06; G01D 7/007; H02J 7/0044
USPC ..... 381/374, 162
See application file for complete search history.

(56) References Cited

U.S. PATENT DOCUMENTS

| | | | | |
|---|---|---|---|---|
| 5,717,767 | A | 2/1998 | Inanagam et al. | |
| 6,603,863 | B1 | 8/2003 | Nagayoshi | |
| 8,502,864 | B1 * | 8/2013 | Watkins | G03B 35/00 348/52 |
| 8,767,996 | B1 | 7/2014 | Lin | |
| 8,977,376 | B1 * | 3/2015 | Lin | H04R 29/00 381/326 |
| 9,106,986 | B2 * | 8/2015 | Shen | H04R 3/00 |
| 9,107,011 | B2 * | 8/2015 | Broadley | H04R 29/00 |
| 9,277,320 | B1 * | 3/2016 | Hoskins | H04R 5/033 |
| 9,277,334 | B1 * | 3/2016 | Wong | H04R 25/606 |
| 9,430,921 | B2 | 8/2016 | Biggs | |
| 2003/0015929 | A1 | 1/2003 | Lee | |
| 2006/0045298 | A1 | 3/2006 | Westerkull | |

(Continued)

FOREIGN PATENT DOCUMENTS

| | | | |
|---|---|---|---|
| WO | WO 2013/0134388 | 9/2013 | |
| WO | WO 2016007920 A1 * | 1/2016 | G06F 3/016 |

OTHER PUBLICATIONS

International Search Report, Application No. PCT/2015/051888, dated Sep. 24, 2015.

(Continued)

*Primary Examiner* — Mohammad Islam
(74) *Attorney, Agent, or Firm* — Knobbe, Martens, Olson & Bear, LLP

(57) ABSTRACT

Apparatus and methods for altering the appearance of wearable device are disclosed. The apparatus may statically or dynamically alter the appearance of the wearable.

12 Claims, 13 Drawing Sheets

(56) References Cited

U.S. PATENT DOCUMENTS

2006/0293722 A1 12/2006 Slatkine et al.
2007/0146317 A1* 6/2007 Schena ..... G01D 7/007 345/156
2007/0290988 A1 12/2007 Nogami et al.
2008/0090622 A1* 4/2008 Kim ..... H02J 7/0044 455/573
2008/0096726 A1* 4/2008 Riley ..... A63B 24/0006 482/8
2008/0194962 A1 8/2008 Randall
2009/0036212 A1 2/2009 Provancher
2010/0134225 A1 6/2010 Yajima et al.
2010/0316235 A1 12/2010 Park
2012/0025742 A1 2/2012 Masahiko
2012/0027222 A1 2/2012 Kirsch
2012/0163269 A1* 6/2012 Shuster ..... H04W 4/206 370/312
2012/0249797 A1* 10/2012 Haddick ..... G06F 1/163 348/158
2013/0022220 A1 1/2013 Dong
2013/0204169 A1 8/2013 Poepperling et al.
2013/0225915 A1 8/2013 Redfield et al.
2013/0339850 A1* 12/2013 Hardi ..... G06F 3/016 715/702
2013/0342521 A1* 12/2013 Griffiths ..... H05B 37/0236 345/212
2014/0056459 A1 2/2014 Oishi et al.
2014/0064536 A1 3/2014 Kim et al.
2014/0125558 A1* 5/2014 Miyajima ..... G06F 17/289 345/8
2015/0070274 A1* 3/2015 Morozov ..... G06F 3/0346 345/156
2015/0081110 A1 3/2015 Houston et al.
2015/0110277 A1* 4/2015 Pidgeon ..... H04R 3/00 381/56
2015/0181338 A1 6/2015 Hosoi et al.
2015/0195663 A1 7/2015 Lin et al.
2015/0242608 A1* 8/2015 Kim ..... G06F 1/3231 726/19
2015/0289034 A1* 10/2015 Engman ..... G09F 27/00 340/870.07
2015/0319546 A1* 11/2015 Sprague ..... G10L 15/26 381/312
2016/0173318 A1* 6/2016 Ha ..... H04W 4/08 709/223
2016/0209648 A1* 7/2016 Haddick ..... G02B 27/0093
2016/0216943 A1* 7/2016 Welti ..... G06F 1/163
2016/0234588 A1* 8/2016 Timothy ..... H04R 1/1091
2017/0059871 A1* 3/2017 Hashiba ..... G02B 27/0179
2017/0123499 A1* 5/2017 Eid ..... G06F 3/04815
2017/0171666 A1 6/2017 Biggs
2017/0180863 A1 6/2017 Biggs

OTHER PUBLICATIONS

International Search Report, Application No. PCT/US2016/052347, dated Jan. 27, 2017.
Verillo, et al "Sensation magnitude of vibrotactile stimuli", Perception and Psychophysics 61: 300-372 (1960).

* cited by examiner

APPARATUS AND METHODS FOR ALTERING THE APPEARANCE OF WEARABLE DEVICES

CROSS-REFERENCE TO RELATED APPLICATIONS

This application claims the benefit of U.S. Provisional Patent Application No. 62/105,356, entitled "APPARATUS AND METHODS FOR ALTERING THE APPEARANCE OF WEARABLE DEVICES," which was filed on Jan. 20, 2015, the disclosure of which is incorporated by reference here in its entirety.

This application is related to U.S. patent application Ser. No. 14/864,278, entitled "SYSTEMS AND METHODS FOR GENERATING DAMPED ELECTROMAGNETICALLY ACTUATED PLANAR MOTION FOR AUDIO-FREQUENCY VIBRATIONS," filed Sep. 24, 2015, which claims the benefit of U.S. Provisional Patent Application No. 62/101,985, entitled "SYSTEMS AND METHODS FOR PROVIDING DAMPED ELECTROMAGNETICALLY ACTUATED PLANAR MOTION FOR AUDIO-FREQUENCY VIBRATIONS," filed Jan. 10, 2015, the disclosures of which are incorporated by reference herein in their entireties.

FIELD OF THE INVENTION

The present invention relates to wearable devices used for entertainment, communication, mobile computing, etc., particularly to the visual appearance of such devices.

BACKGROUND OF THE INVENTION

Static methods for changing the visual appearance of a wearable device are known in the art. FIG. 1 shows a view of a prior art static apparatus 110 for changing the visual appearance of a wearable device. There is presently a market, for example, for adhesive decals that customize the appearance of headphones. A drawback is that users find the adhesive decals difficult to apply with good alignment, with the process typically requiring about fifteen minutes of work. Furthermore, once the decals are applied, they are not easily removed if the user wishes to change the device's appearance.

Wearables having internal lights and a translucent cover are also known in the art. FIGS. 2A and 2B show views of a prior art wearable device 200 having removable colored lights. In particular, FIG. 2A shows display apparatus 210 including an array of seven LEDs 212 within the interior of a translucent headphone case 214 that cause the case to glow with changing colors. This approach to wearable customization presents a number of major problems, including difficultly in programming and charging the lights as both actions require opening of the case. Another key drawback to this approach is that the display lacks spatial resolution. Since the cover is translucent, not transparent, it cannot display detailed images, only solid colors.

Dynamic wearable visual displays are also known from prior art. FIGS. 3A and 3B show views of a prior art wearable device with an animated display 310 driven by a detachable battery/controller pack 320. In particular, FIG. 3 shows a garment 300 with an embedded LED display panel 310. The main drawback of incorporating the visual display in a soft article of clothing like a shirt is discomfort to the wearer. The relatively stiff display does not accommodate biaxial bending or stretching and can feel awkward to the wearer. Also problematic are the stiffness of the wire and the bulk of the battery/controller pack 320.

Headphones with passive detachable decorative plates are also known from the prior art. FIG. 4 shows a view of a prior art headphone 400 with mass-produced passive decorative plates 410 that affix by means of a circumferential snap-fit ridge that engages a receiving groove on the circumference of the housing. A first drawback of this system is the lack of customization; mass production of plates does not afford the wearer an opportunity to customize the appearance of their personal headphone, for example by specifying a monogram at the time of ordering the plate. A second drawback of this system is that the ear cup housing does not provide an electrical connection to the cap. Thus the system only supports the mounting of unpowered, inert decorative plates, limiting the ability to change the appearance of the device dynamically by the action of electrical current that moves a mechanism or patterns a visual display.

SUMMARY OF THE DISCLOSURE

Apparatus and methods for altering the appearance of wearable device are disclosed. The ability to alter the appearance of wearable devices quickly and easily is desirable for several reasons. First, the wearer may desire that their device offer a variety of customized appearances, as do clothing and jewelry. Accordingly, in some embodiments, the wearable device may include one or more mechanical features to permit quick and easy changes of exterior parts, such as a twist-lock mechanism, for example. The quick-connect plates disclosed herein may be easily aligned and attached in a few seconds. The incorporation of a dynamic, refreshable visual display on the surface of the wearable device in some embodiments makes customization easier still.

Second, users may adopt a new wearable product more quickly if it has an appearance that demonstrates a product function. Thus, in some embodiments, a wearable device may include one or more visible features, such as a moving needle that makes the device's low frequency, tangible vibrations clearly visible, for example.

Third, wearable devices in accordance with some embodiments may include electronics for controlling the appearance of a wearable device. For example, wearable devices may be equipped with a dynamic visual display that facilitates surface animation and/or rapid changes in appearance. Programming the display through an Internet-connected device, such as the wearable device itself or through a device communicatively coupled to the wearable device, may facilitate financial transactions related to that display space between a user of the wearable device and a third party. For example, a third party may rent the display for advertisement, like a billboard, and/or a user may purchase visual content for the display, as users now buy physical items like clothing and jewelry. As opposed to prior art systems, the wearables disclosed herein may incorporate visual displays on portions of a wearable device that do not contact the skin, such as the exterior ear cup of headphones, for example. Accordingly, the display does not compromise the comfort already provided by the ear cushions. Furthermore, there is no need for an external wire and battery pack since the headphones naturally provide a rechargeable source of battery power and signal for driving the visual display.

BRIEF DESCRIPTION OF THE DRAWINGS

For a fuller understanding of the inventive embodiments, reference is made to the following description taken in connection with the accompanying drawings in which.

BRIEF DESCRIPTION OF THE PREFERRED EMBODIMENTS

Figure 1:
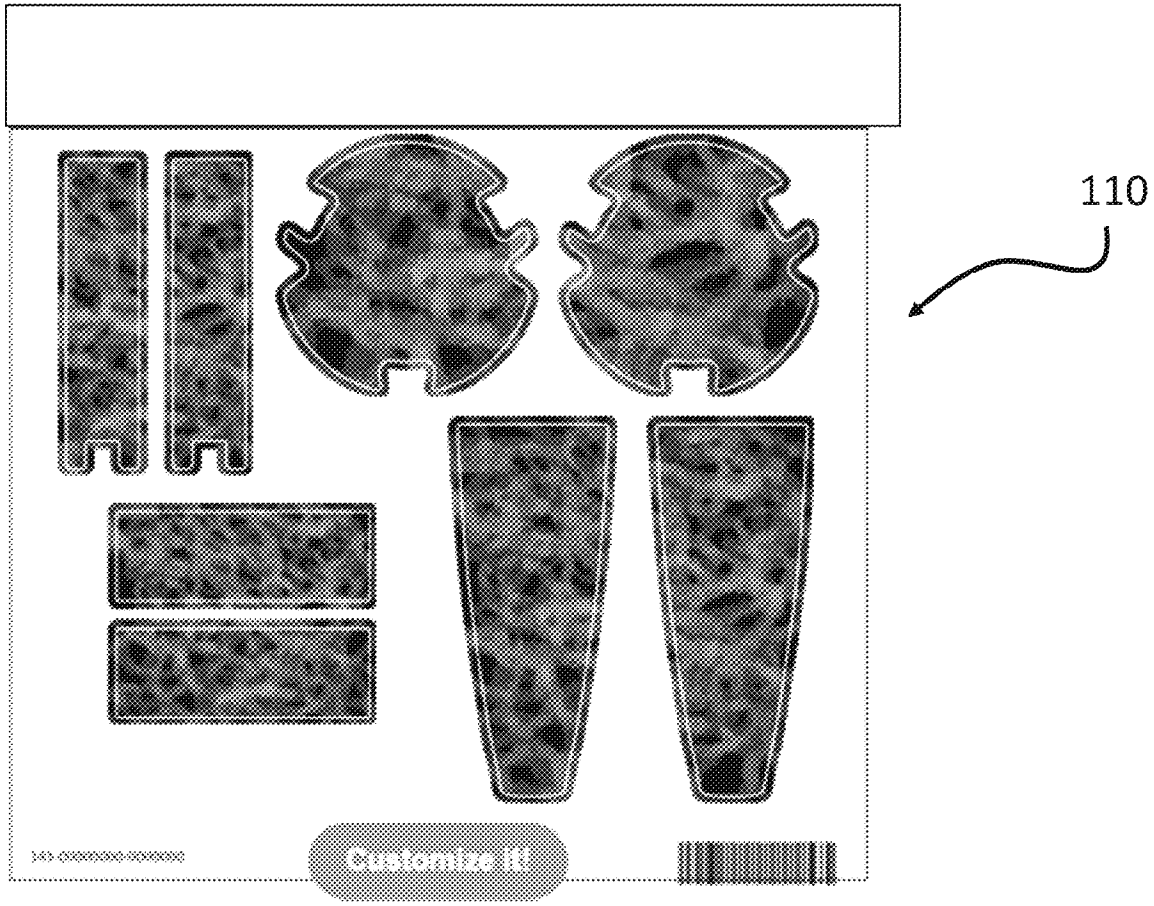
FIG. 1 shows a view of a prior art static apparatus for changing the visual appearance of a wearable device.
Figure 2B:
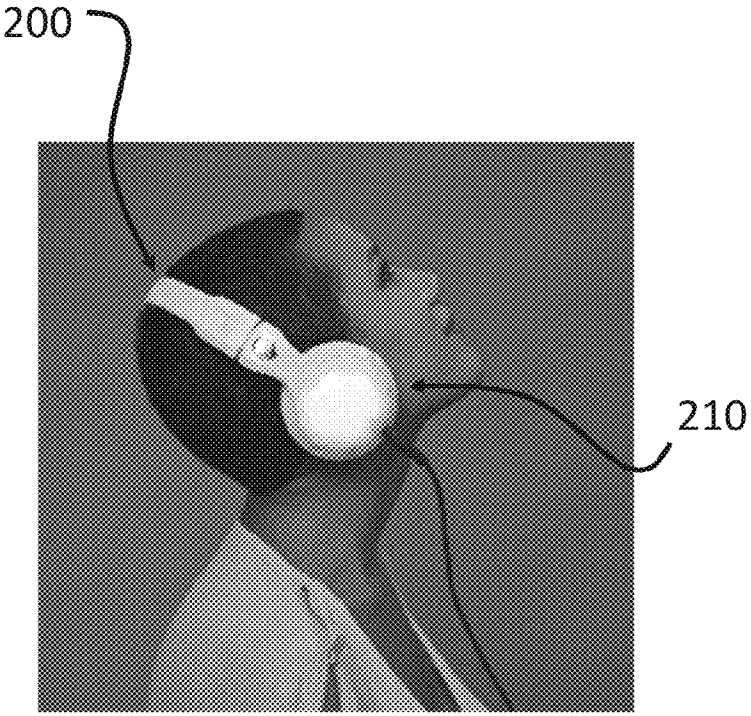
FIGS. 2A and 2B show views of a prior art wearable device having removable colored lights.
Figure 2A:
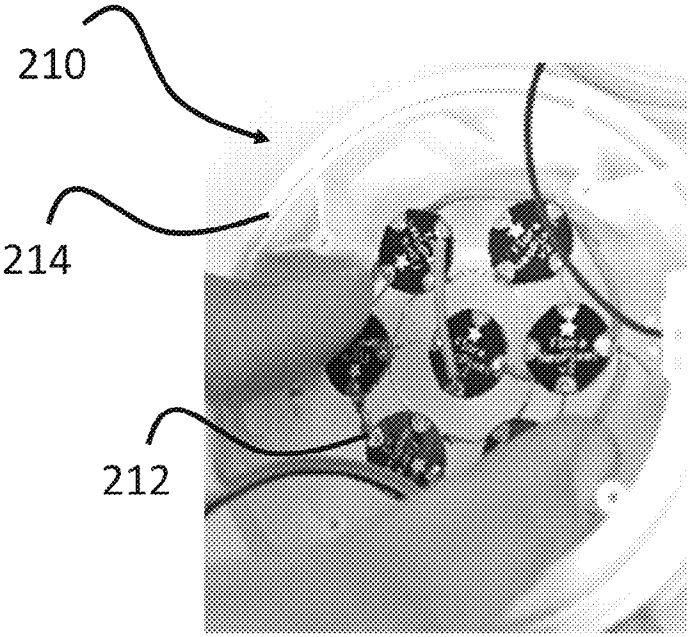
Figure 3B:
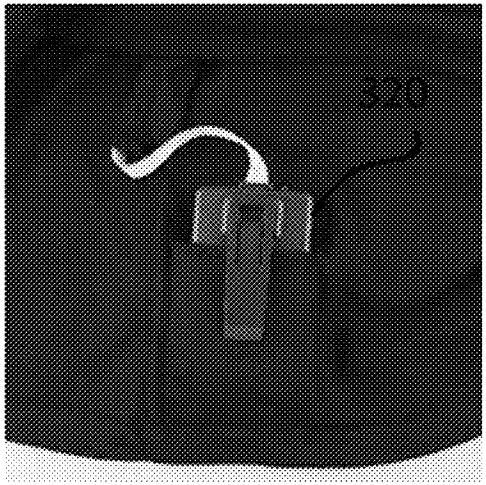
FIGS. 3A and 3B show views of a prior art wearable device with an animated display driven by a detachable battery/controller pack.
Figure 3A:
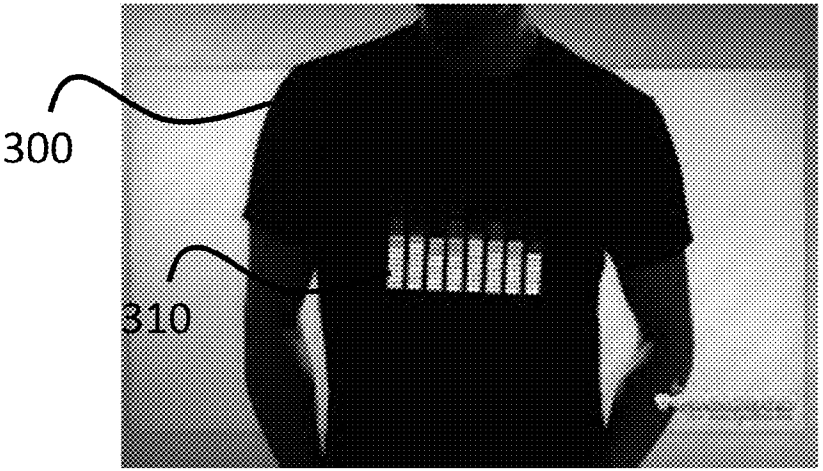
Figure 4:
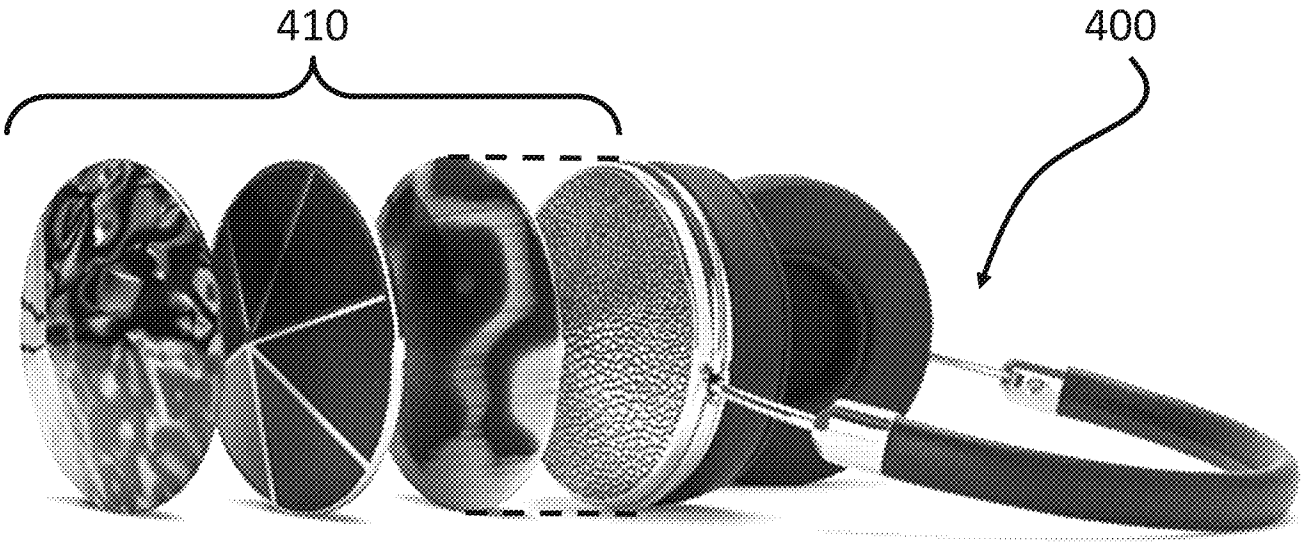
FIG. 4 shows a prior art wearable device with reversibly attachable decorative plates.
Figure 5:
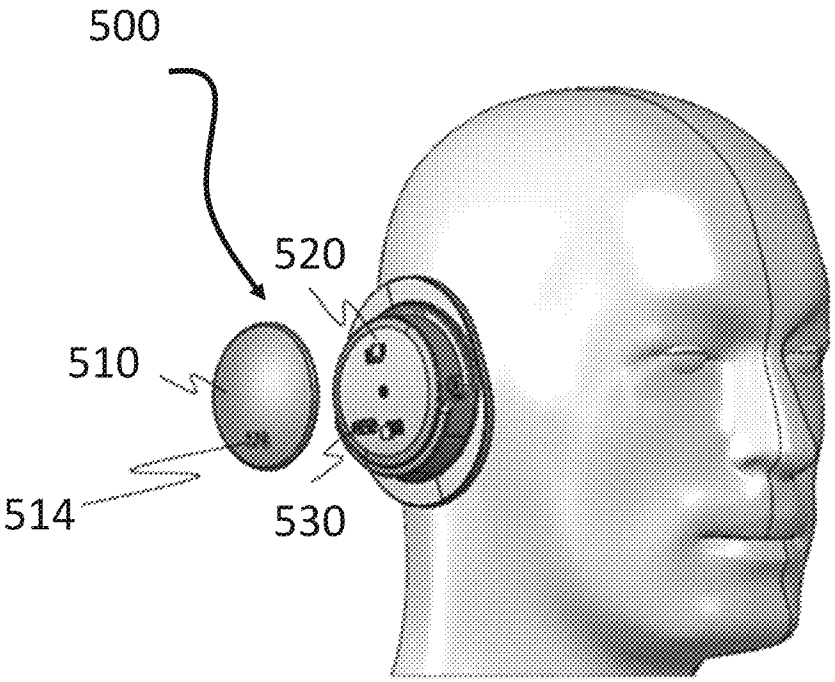
FIG. 5 shows a partially exploded view of a customizable wearable device, in accordance with various embodiments.

FIG. 5 shows a partially exploded view of a customizable wearable device, in accordance with various embodiments. In particular, FIG. 5 shows an exemplary wearable device in the form of a headphone ear 500 cup with a quick-change plate 510. A variety of plate colors and textures may be attached to the headphone cup to alter the appearance of the wearable device to suit the wearer. Customized features 514, such as the user's monogram, favorite color, or print may be provided in the plate. In some embodiments, the plate may include a clear display space into which the user may slide the printed image of his or her choice. The quick-change plate may be removably coupled to the headphone ear cup using any suitable coupling mechanism 520, such as a twist-lock feature or one or more clips, magnets, or fasteners, for example.

In some embodiments the housing of the wearable device can provide electrical connection points 530 for communications signals and battery power. Connection points 530 may support actively programmable plates, powered by a battery, that render a visual appearance programmed by an electrical input signal. In these embodiments, the plate may include a digital display, such as a plasma, LCD, LED, or OLED display, for example, for rendering a selected visual appearance. The electrical connections may be made via pogo pins or spring contacts, for example.

Figure 6B:
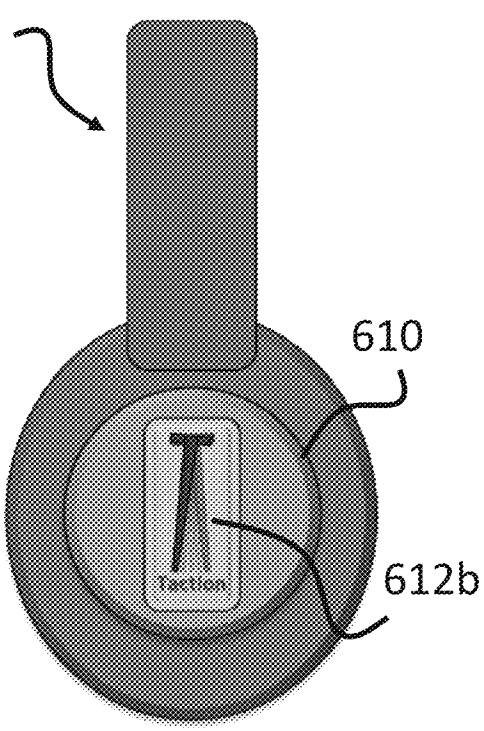
FIGS. 6A and 6B show side views of a wearable device having a visual feature that demonstrates a product function, in accordance with various embodiments.
Figure 6A:
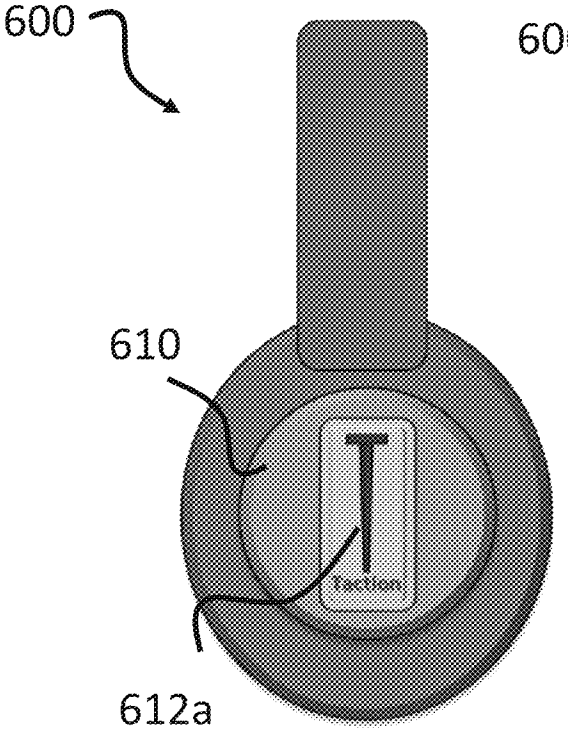

FIGS. 6A and 6B show side views of a wearable device having a visual feature that demonstrates a product function, in accordance with various embodiments. In particular, FIGS. 6A and 6B show a cover-plate including a visual feature that demonstrates low-frequency vibration of the headphones, which may help an observer distinguish the wearable from a wearable lacking this feature. In this example, the visual feature can include a moving needle or printed card bearing the image of a needle. In the absence of vibration (FIG. 6A) the needle 612*a* may be still. When the headphones vibrate (FIG. 6B) the needle can move, as indicated by the blurred image.

Figure 7A:
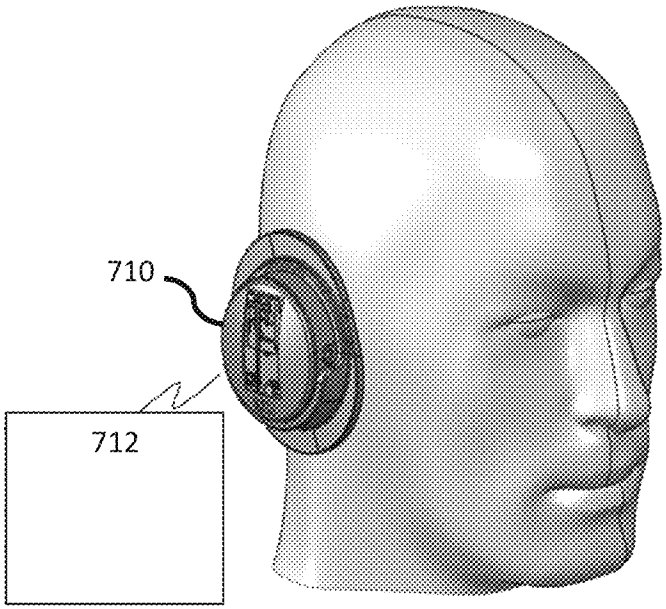
FIG. 7A shows a perspective view of a customizable wearable device having a visual feature that demonstrates a product function, in accordance with various embodiments.

FIG. 7A shows a perspective view of a customizable wearable device having a visual feature that demonstrates a product function, in accordance with various embodiments. In particular, FIG. 7A shows the visual feature that demonstrates a product function of FIGS. 6A and 6B integrated into the quick-change plate of FIG. 5. Rather than being integrated into a quick-change plate, however, in some embodiments, the visual feature 712 may be integrated into the wearable device itself such that the appearance of the wearable device can be altered while retaining the visual feature.

Figure 7B:
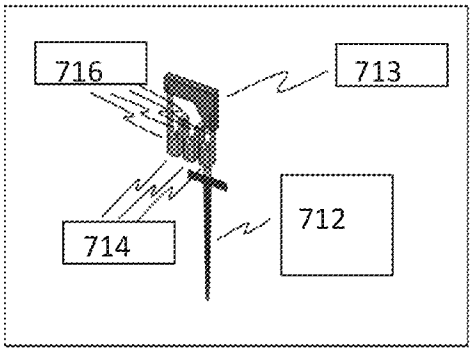
FIG. 7B shows a perspective view of the illustrative visual feature of FIG. 7A that demonstrates a product function, in accordance with various embodiments.
Figure 7C:
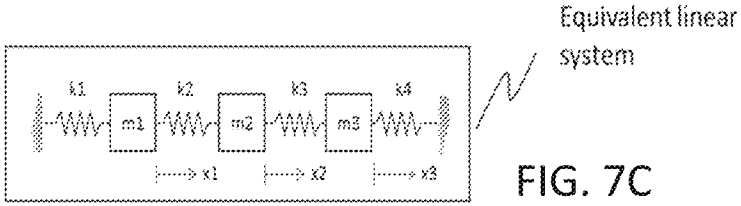
FIG. 7C shows a schematic view of an equivalent linear system representation of the visual feature of FIGS. 7A and 7B, in accordance with various embodiments.

FIG. 7B shows a perspective view of the illustrative visual feature 711 of FIG. 7A that demonstrates a product function, in accordance with various embodiments. The visual feature may include a base member 713 having a vibration indicator 712 coupled to a mass-spring system that provides one or more resonant frequencies in the 15-200 Hz range. This system can visually amplify the vibrations, so that the wearer and others can see the vibrations. In FIG. 7B the masses 714 are suspended on flexures 716, with spring rates chosen to provide multiple resonances within the desired frequency range (e.g., 15-200 Hz). The flexural system may be approximately equivalent to a linear mass-spring system with well-characterized dynamic equations, simplifying design for the target resonant frequencies as pictured, for example in the schematic view of FIG. 7C. The resonant system may be housed, for example, behind a transparent portion of the cover plate 710.

Figures 8A, 8B, 8C:
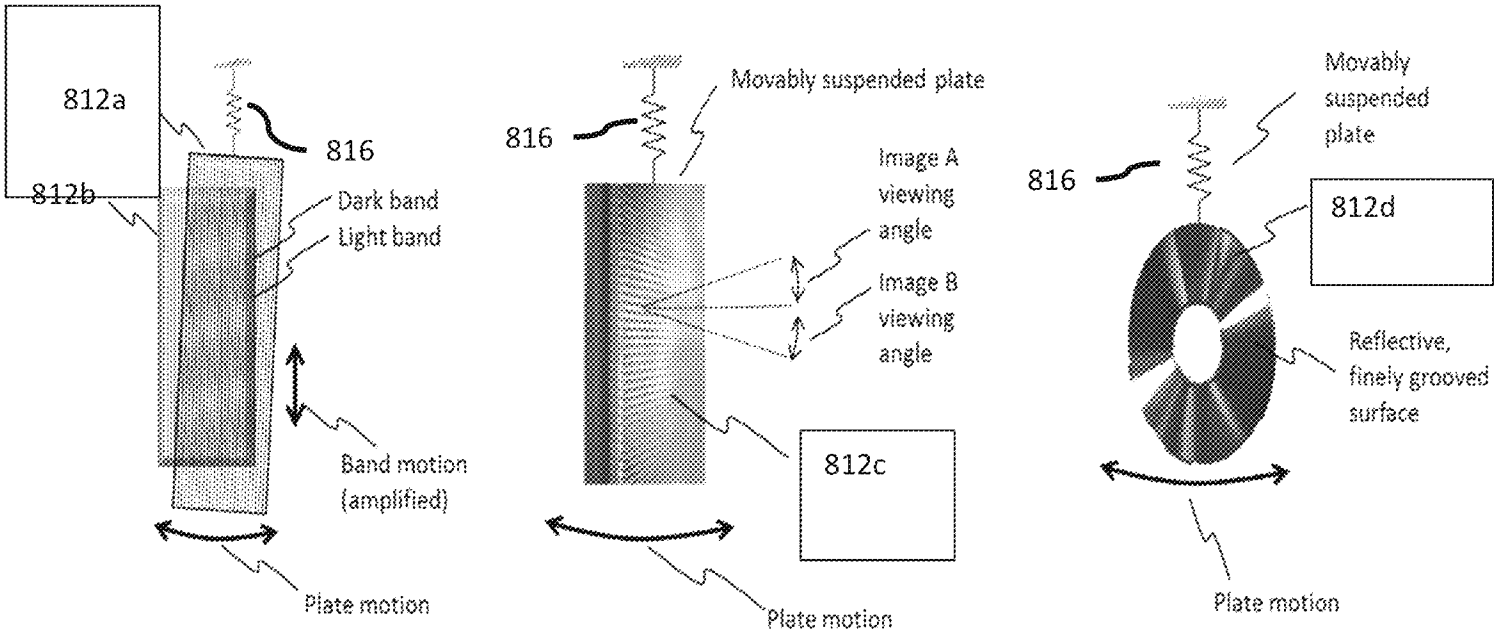
FIGS. 8A-8C show various visual features that demonstrate a product function, in accordance with some embodiments.

This specific mechanical example disclosed with respect to FIGS. 6-7 illustrates only one of many ways of amplifying small vibrations to make them visually apparent. Other methods of visual amplification are explicitly contemplated. As shown in FIG. 8A, for example, Moiré patterns produced by suspended overlapping transparent plates 812*a* and 812*b* printed with lines or dots can visually amplify the vibrations of the wearable device. Likewise, as shown in FIG. 8B, materials that change appearance due to small changes in viewing angle may also be suitable. For instance, an image made on a suspended plate 812*c* using lenticular printing may be used for this purpose. Yet another method of achieving visual amplification may involve a movably suspend a reflective diffraction grating 812*d*, commonly available as "holographic" or "rainbow" wrapping paper, as shown in FIG. 8C. It is clear to one skilled in the art that any one of these methods, among many others, can make vibration visually apparent in the wearable device, and all lay within the scope of the present invention.

The visual features disclosed with respect to FIGS. 6-8 may be understood to be "passive" visual features, as they may rely upon purely mechanical means to visually amplify a product feature, such as low-frequency vibrations. On the other hand, a wearable device may also incorporate one or more "active" visual features, which may incorporate one or more electric or electronic components. Various embodiments of active visual features for wearable devices are disclosed below with respect to FIGS. 9-14.

Figure 9B:
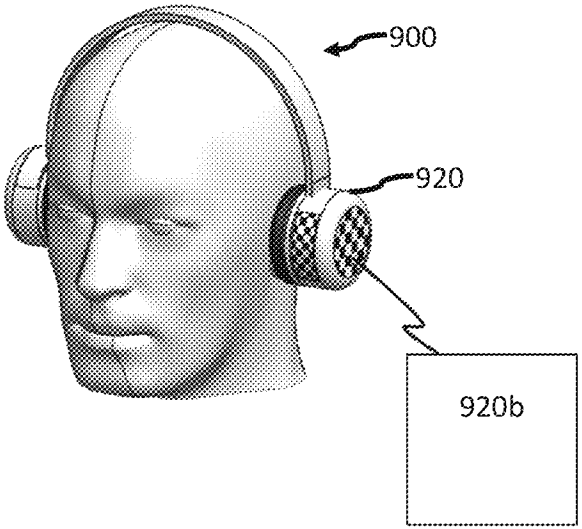
FIGS. 9A and 9B show perspective views of wearable devices having active visual displays, in accordance with various embodiments.
Figure 9A:
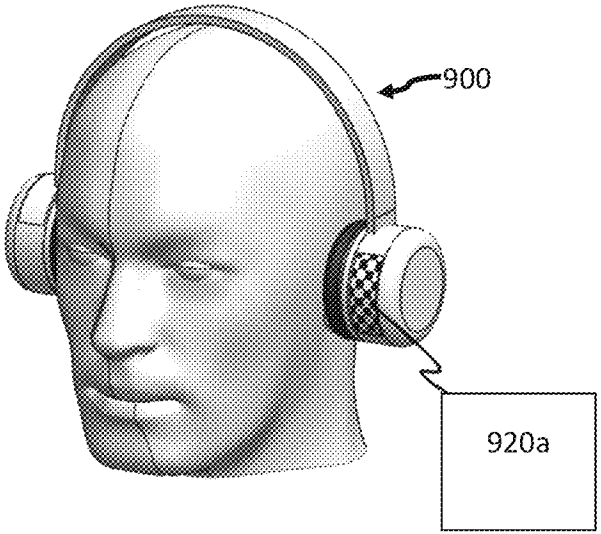

FIGS. 9A and 9B show perspective views of wearable devices having active visual displays 920*a* (FIG. 9A) and 920*a* and 920*b* (FIG. 9B), in accordance with various embodiments. In FIGS. 9-14, generic active visual displays may be represented by a black-and-white checkerboard pattern. According to various embodiments, the visual displays may be mounted in a detachable cover plate 910, which may be similar to the quick-change plate of FIG. 5, for example, or the visual display may be permanently integrated into the wearable device. The locations of visual displays 920*a* and 920*b* are merely exemplary, and a wearable may include a visual display at any suitable location.

FIG. 10 shows a pictorial view of programming the visual display of FIGS. 9A and 9B, in accordance with various embodiments. In particular, a computing device 1030, such as a desktop computer, laptop computer, or mobile device, for example, can provide an interface 1032 for programming a visual display on a wearable device. For instance, the wearer of the wearable device can use application software running on the computing device to select a "skin" that sets the appearance of their visual displays) 1020. The skin may be a static or moving image in accordance with various embodiments. Skins may be stored locally on computing device 1030 and/or stored remotely in a storage medium communicatively coupleable to computing device 1030 (e.g. skins stored on a web server or remotely accessible database).

Figure 10B:
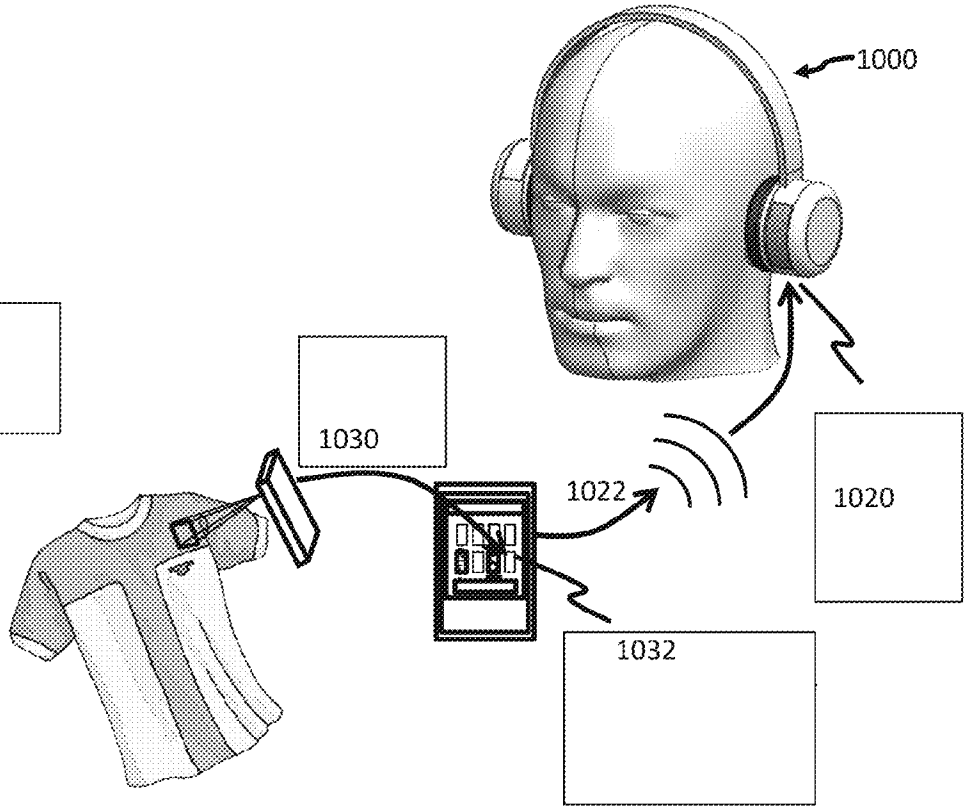
FIGS. 10-13 show pictorial views of selection of visual content for presentation on a wearable device, in accordance with various embodiments.
Figure 10A:
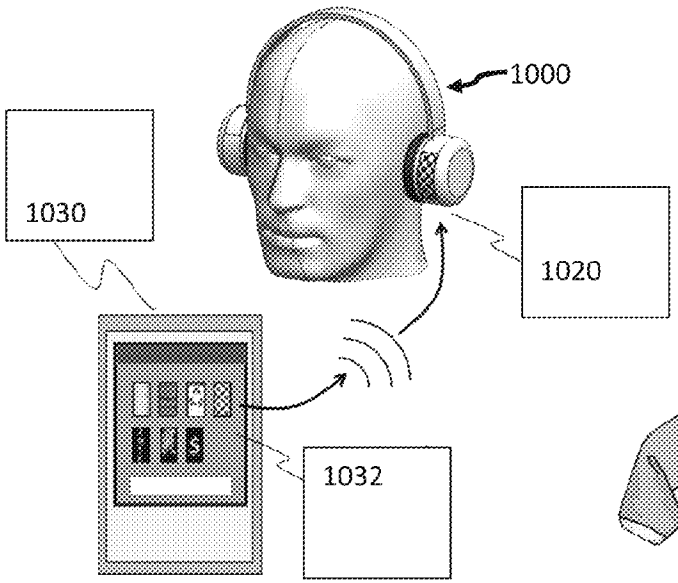

FIG. 10B shows a pictorial view of programming the visual display of FIG. 10A, in accordance with various embodiments. In particular FIG. 10B shows how a user can generate the visual content 1022 to populate visual display 1020 by capturing one or more aspects of the environment. For example, the user may take a photograph to obtain a representation of the color and texture of the user's clothing, such as the user's shirt. Computing device 1030 can then generate visual content 1022 that may be presented on the display such that the wearable device matches the user's apparel that day. In some embodiments, visual content 1022 may be stored remotely or locally on computing device 1030 or wearable device 1000.

Communication between wearable device 100 and computing device 1030 may occur through a wireless communication protocol such as Bluetooth or Wi-Fi, or a wired communication protocol, such as USB, for example. In some embodiments, information for addressing the display may be encoded in the audio signal encoded in the low frequencies of an audio signal 9 e.g., <15 Hz) or in the upper frequencies of an audio signal (e.g. >10 KHz)

Figure 11:
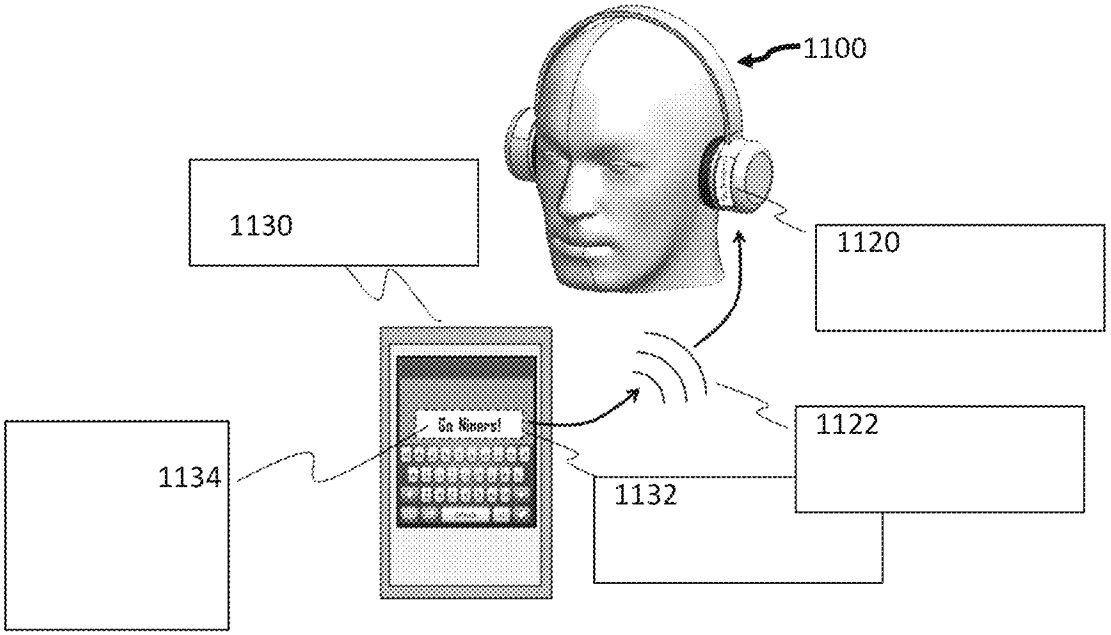

Since dynamic addressable visual displays based on a variety of technologies are now available (e.g. LED, LCD, e-Ink, electrowetting, etc.), it may be possible to drive the visual display with dynamic images. As shown in FIG. 11, software running on a user's computing device 1130 can continuously send visual content 1122 to the display on the wearable electronic device 1100. In some embodiments, the display on the wearable device 1100 may dynamically mirror at least a portion 1034 of the user's mobile handset screen 1032. This feature may enable the user to display any and all content on their mobile device, for any purpose. For instance, if the user wishes to display at least a portion of one or more social media feeds, such as Twitter or Instagram, for example, this is possible. As another example, the user may be able to display text, such as "Go Niners!," for example. In some embodiments, any locally or remotely stored content, including images, videos, and text, for example, may be available for the user to display as communication or ornament.

Display 1120 may be programmed through an application that runs on computing device 1130. The application may may command the visual display to render, for example, album art, a playlist, a music video, decorative images, still or animated, images associated with advertising, such as corporate logos, images belonging to the user, such as a slide show of photographs from the user's photo gallery.

Figure 12:
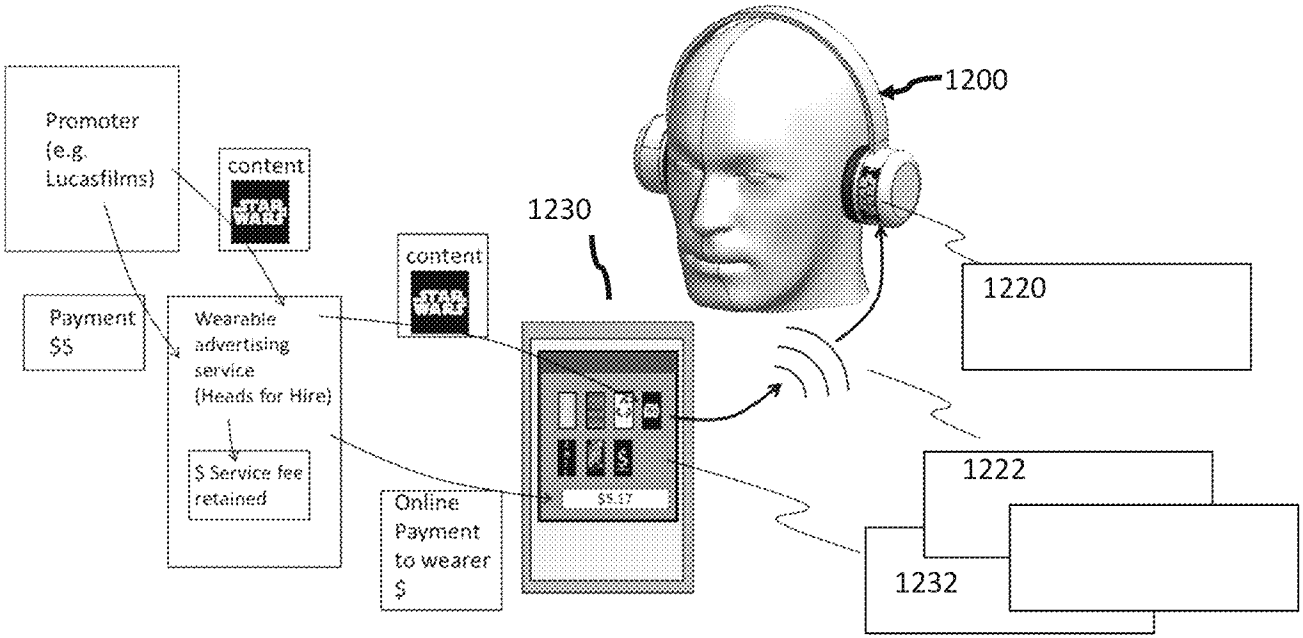

A wearable visual display coupled to a computing device may have value to parties other than the user. For example, the display may be used as a billboard if the user so chooses. FIG. 12 shows a pictorial view of programming the visual display of FIGS. 9A and 9B as a billboard, in accordance with various embodiments. When a wearable device includes a visual display on it, the display space that may be leased out by the wearer, for example, for promotion.

In these embodiments, the user may connect to a wearable advertising service via through software running on, or an Internet website accessible by, the wearable or a computing device communicatively coupled to the wearable device. With an account on the site, the user may receive payment in exchange for displaying promotional content on his wearable display. Said service may retain a portion of the payment from the promoter to the wearer, in exchange for providing the infrastructure for the transaction.

Figure 13:
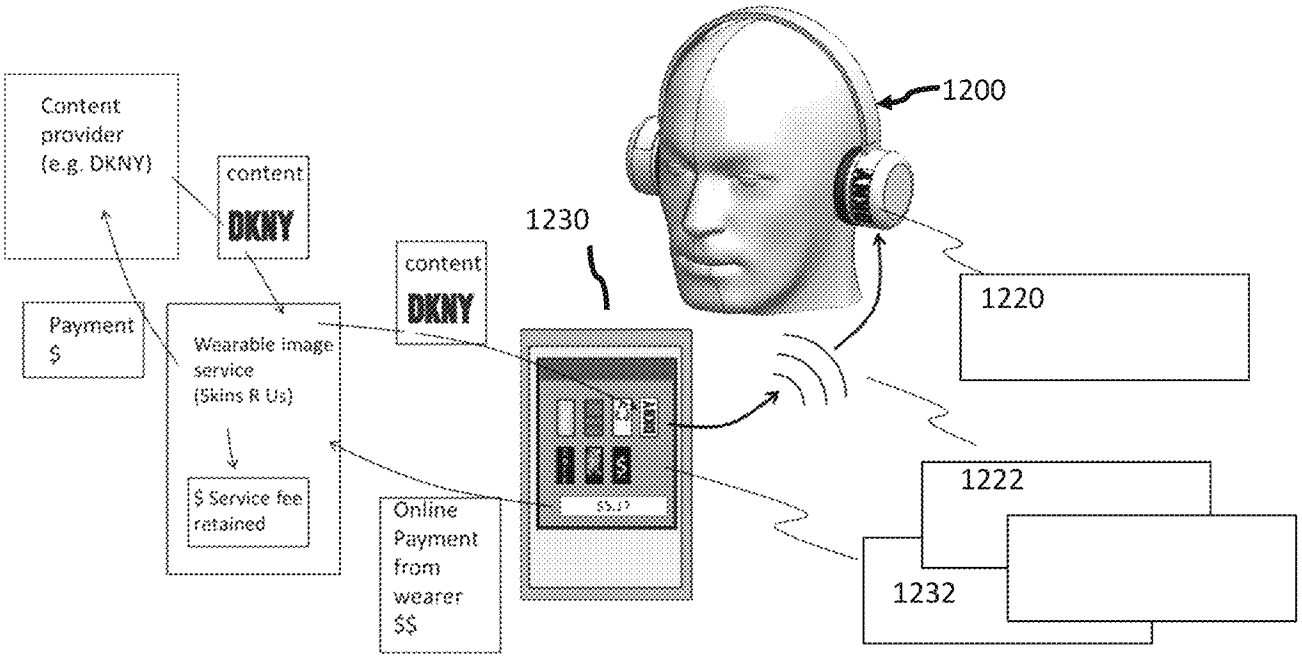

Just as a wearable device display may have value to other parties, it may also have value to the user himself. As such, he may wish to purchase content for his display from another party. An example of this kind of transaction is illustrated in FIG. 13. Here the user has connected to an Internet-based wearable image service and purchased content from a provider, for example a clothing designer. To provide more visual interest than a simple logo, the designer may produce dynamic visual images. This poses an interesting new area for clothing designers, who will have an opportunity to produce wearable dynamic video images. Whatever the purchased content, the present invention discloses an online service that retains a portion of the transacted amount in exchange for providing the physical and software infrastructure that supports the transaction.

What is claimed is:

1. A wearable device, comprising:

an ear cup;

one or more visual features that displays a representation of one of an intensity of sound in the ear cup and a vibration of the ear cup;

wherein the one or more visual features comprise a mass-spring system that amplifies motion of the ear cup, wherein the mass-spring system comprises:

at least one flexure mechanically coupled to the ear cup housing; and at least one mass suspended from each of the at least one flexure; and wherein the at least one mass comprises at least one of:

a plate with passive visual features that visually amplify the movement of a transparent oscillating plate with Moiré patterns; and an oscillating plate with lenticular printing.

2. The wearable device of claim 1, wherein said plate with optical features comprises an outermost surface of said wearable device and is at least partially transparent or translucent.

3. The wearable device of claim 1, wherein spring constants of the at least one flexure are chosen to establish one or more resonant frequencies of the mass-spring system in the 15-200 Hz range.

4. The wearable device of claim 1, wherein said plate with passive visual features comprises an outermost surface of said wearable device and is at least partially transparent or translucent, and is removably attached to said wearable device.

5. The wearable device of claim 1, wherein said plate with passive visual features comprises an outermost surface of said wearable device, and said plate is removably attached to said wearable device with a mechanical coupling, said mechanical coupling comprising at least one of:

a snap fit coupling;

a twist lock fit coupling; and a screw-on coupling.

6. The wearable device of claim 1, wherein said plate with passive visual features comprises an outermost surface of said wearable device, and said plate is removably attached to said wearable device with a mechanical coupling, said mechanical coupling comprising at least one of:

metal or plastic snaps;

one or more hook and loop fasteners; and one or more magnets.

7. A wearable device, comprising:

an ear cup;

one or more visual features that displays a representation of one of an intensity of sound in the ear cup and a vibration of the ear cup;

wherein the one or more visual features comprise a mass-spring system that amplifies motion of the ear cup, wherein the mass-spring system comprises:

at least one flexure mechanically coupled to the ear cup housing; and at least one mass suspended from each of the at least one flexure; and wherein the wearable device comprises at least one of:

a plate with passive visual features that visually amplify the movement of said transparent oscillating plate with Moiré patterns or an oscillating plate with lenticular printing.

8. The wearable device of claim 7, wherein said plate with passive visual features comprises an outermost surface of said wearable device and is at least partially transparent or translucent.

9. The wearable device of claim 7, wherein spring constants of the at least one flexure are chosen to establish one or more resonant frequencies of the mass-spring system in the 15-200 Hz range.

10. The wearable device of claim 7, wherein said plate with passive visual features comprises an outermost surface of said wearable device and is at least partially transparent or translucent, and is removably attached to said wearable device.

11. The wearable device of claim 7, wherein said plate with passive visual features comprises an outermost surface of said wearable device, and said plate is removably attached to said wearable device with a mechanical coupling, said mechanical coupling comprising at least one of:

a snap fit coupling;

a twist lock fit coupling; and a screw-on coupling.

12. The wearable device of claim 7, wherein said plate with passive visual features comprises an outermost surface of said wearable device, and said plate is removably attached to said wearable device with a mechanical coupling, said mechanical coupling comprising at least one of:

metal or plastic snaps;

one or more hook and loop fasteners; and one or more magnets.

* * * * *